United States Patent [19]

Pantaleon-Stemberg

[11] Patent Number: 4,832,018

[45] Date of Patent: May 23, 1989

[54] FILTER CASE HOLDER

[75] Inventor: Gerd Pantaleon-Stemberg, Moelln, Fed. Rep. of Germany

[73] Assignee: Draegerwerk AG, Fed. Rep. of Germany

[21] Appl. No.: 259,505

[22] Filed: Oct. 17, 1988

Related U.S. Application Data

[63] Continuation of Ser. No. 59,065, May 21, 1987, abandoned.

[30] Foreign Application Priority Data

Jun. 10, 1986 [DE] Fed. Rep. of Germany ..... 3619479

[51] Int. Cl.[4] ..... A62B 18/02

[52] U.S. Cl. ..... 128/206.17; 128/206.27

[58] Field of Search ..... 128/206.27, 206.29, 128/206.12, 206.17

[56] References Cited

U.S. PATENT DOCUMENTS 2,744,523 5/1956 Malcom ..... 128/206.17

FOREIGN PATENT DOCUMENTS 2100661 7/1972 Fed. Rep. of Germany ..... 128/206.17

7116675 2/1975 Fed. Rep. of Germany .

802235 6/1936 France ..... 128/206.17

*Primary Examiner*—Alan Cohan

*Attorney, Agent, or Firm*—McGlew & Tuttle

[57] ABSTRACT

A filter case for respiratory masks, in which filter inserts are held replaceably by a holder engaging in the case wall, is improved so that filter inserts of different structural heights and in various combinations can be fastened in it with the same holder. For this purpose, the holder includes a sleeve open at both ends surrounding a filter insert that can be fastened to the inner wall of the filter case and can be moved axially by a fastener necking inward at one of the end circumference of the sleeve. A respirator mask filter holder, comprising a casing having a wall with a tubular side, a sleeve 2 engaged in said tubular said 1 and being axially moveable therein, a filter cover having replaceable filters therein and having a projecting lip, and a fastener collar carried by said sleeve and engageable with said lip upon with said lip upon inward movement of said sleeve to position said filter case against said end wall.

2 Claims, 1 Drawing Sheet

FILTER CASE HOLDER

This is a continuation application of application Ser. No. 059,065, filed May 21, 1987, now abandoned.

FIELD AND BACKGROUND OF THE INVENTION

This invention relates in general to breathing apparatus and in particular to a new and useful filter case for respirator masks in which filter inserts are held replaceably by a holder engaged in the case wall.

A similar filter case has been disclosed by German Registered Design No. 71 16 675. The known filter case is used to hold filter inserts that have collars on their front faces, which rest against the edge of the filter case when the filter is inserted. A cover is screwed onto a male thread of the filter case and presses the filter collar tightly against the edge of the filter case.

If several filters, for example a gas filter and a dust filter, are to be fastened together in the filter case, a higher or deeper cover is necessary because of the greater overall height of the two filters, and thus presses both filters mutually tightly against the edge of the filter case. The individual filter inserts also have different structural heights depending on the design and purpose of use. When using the higher cover to hold only one filter insert or to hold several filter inserts that differ in overall height, there is an unnecessarily large space requirement for the filter case, which therefore becomes bulky and unwieldy.

On the other hand, if only one filter insert of distinctly greater structural height is to be used, the screw cover provided for it then runs into the filter insert before the screw thread can grip securely.

The use of the known respirator mask is therefore also compelled to stock and to use the corresponding screw covers for the use of various filter inserts of different structural heights.

SUMMARY OF THE INVENTION

The invention provides a filter case for respirator masks constructed so that filter inserts of different structural heights and in various combinations can be fastened in it with the same holder.

The holder comprises a sleeve, open at both ends, and surrounding the filter insert which can be fastened to the inner wall of the filter case and can move axially and which is provided at one end circumference with a fastener that necks inward.

In using such a sleeve as a holder, the benefit is obtained that the case wall of the filter case can have a variable configuration to hold filter inserts of different structural heights. To retain filter inserts with a structural height that exceeds the depth of the case wall, the sleeve only needs to be inserted over a smaller distance in the case wall until the holder presses the filter insert firmly and tightly against the bottom of the case. If filter inserts of smaller structural height are to be fastened, the sleeve is inserted correspondingly deeper into the case wall.

The sleeve can be pushed into the filter case either so that the holder serves as an extension of the case wall, or conversely it can be pushed into the case wall so that the holder points toward the bottom of the case and thus acts as a shortening of the case wall. Because of this, filter inserts of the smallest structural height can also be fastened securely and tightly.

Therefore, the arrangement of the sleeve in the filter case pursurant to the invention makes possible a clamping range for filter inserts of different structural heights and in different combinations, that reaches practically from the bottom of the filter case to the structural height of the filter case including the free structural height of the sleeve. This permits the universal use of a respirator mask, which can then optionally be equipped as required with the widest variety of filters, without the necessity of providing corresponding holders such as screw covers each time.

In a particularly simple way, the sleeve is provided with a male thread so that it can be screwed into a corresponding female thread of the filter case. Another possibility of arranging the sleeve to be shifted includes inserting a spring washer in a corresponding groove on its smooth outer surface of the sleeve that is pressed along the smooth inner surface of the filter case and thus makes possible a reliable shifting of the sleeve and also a firm seat to fasten the filter inserts.

In another refinement of the invention, the holder is constructed as a collar surrounding the end circumference of the sleeve. This collar either presses the filter insert itself against the bottom of the filter case, or a gasket lip attached to the foot of the filter insert is engaged by the collar. The collar encircling the end circumference also provides the beneficial possibility of securely holding smaller filter inserts also, that do not reach to the inner surface of the sleeve.

It is recommended for the sleeve to be knurled at both ends, by which the sleeve is either screwed into the filter case or can be pushed in.

The filter inserts preferably have a flange that can be designed as a gasket lip or bulge, by which they are held by the sleeve in the filter housing while retaining the smallest possible structural height.

Accordingly it is an object of the invention to provide a respirator mask filter holder which comprises a casing having a wall with a tubular side and a sleeve engaged in the tubular side and be axially moveable therein and including a filter cover having replaceable filters therein having a side wall with a projecting lip and including a fastener collar carried by the sleeve which is engageable with the lip upon inward movement of the sleeve within said tubular side positioning the filter case against the end wall.

A further object of the invention is to provide a case for holding one or more filter aliments in respect to the casing end wall of a respirator which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

While specific embodiments of the invention have been shown and described in detail to illustrate the application of the principles of the invention, it will be understood that the invention may be embodied otherwise without departing from such principles.

GENERAL DESCRIPTION OF THE PREFERRED EMBODIMENTS

Figure 1:
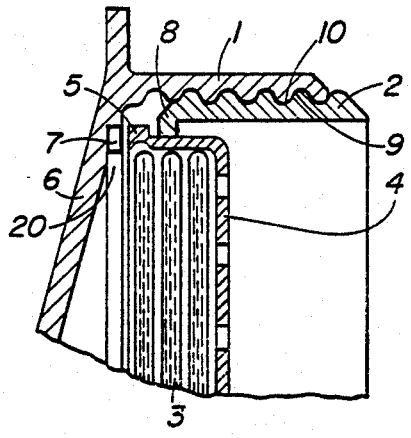
FIG. 1 is a partial cross sectional view through a filter case with a filter clamped therein constructed in acordance with the invention.

Referring to the drawings in particular the invention comprises a respirator mask filter holder having a housing casing bottom 6 with a tubular side wall or filter case 1 into which a sleeve 2 in engageable. In accordance with the invention the sleeve 2 is axially moveable within the side wall 1 and for this purpose it advantageously includes an exterior thread 9 which is engageable with a female thread 10 of the side wall 1 of the filter casing.

In accordance with the invention sleeve 2 carries a collar or fastener 8 which projects inwardly toward a perforated tray or case cover 4 for one or more filters 3 which in the present embodiment comprises coarse dust filter inserts. The inward threading movement of the sleeve is effective to cause the fastener 8 to engage a lip 5 of the cover 4 and position the end of this lip into an engagement with a gasket 7 carried on a ledge 20 at the interior of the case bottom 6.

To fasten the coarse dust filter insert 3 in the filter case 1, the filter cover 4 is placed against the gasket 7 and is pressed against the case bottom 6 by threading the sleeve 2 onto the thread 10 of the filter base 1 so that its collar 8 presses against the lip 5 to move it against the gasket 7.

Figure 2:
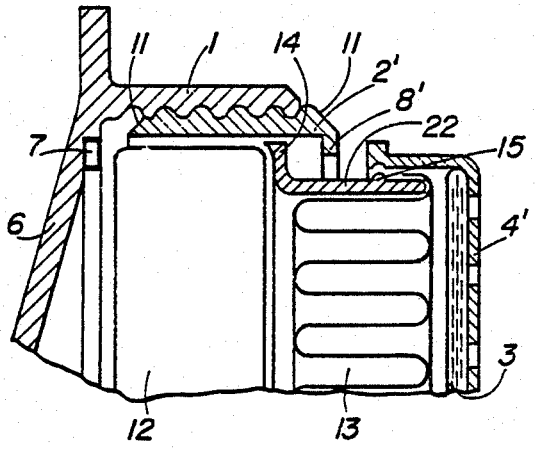
FIG. 2 is a partial cross sectional view of another arrangement of the filter case with a double filter clamped therein.

In FIG. 2, a double filter or a gas filter 12 and a particle filter 13 are fastened in the filter case 1. For this purpose, a sleeve 2 is screwed into the filter case 1 such that the sleeve is oriented with a collar 8 at its outer end engaging a sealing bead or collar 14 of a cover 22 for a particle filter 13. The sleeve 2 in this case is screwed in with its collar 8 pointing away from the bottom of the case 6, so that the gas filter 12 is pressed against the gasket 7 by the pressure on the sealing bead 14 of the cover 22 of the particle filter 13. At the same time, the joint between the gas filter 12 and the particle filter 13 is sealed by the sealing bead 14. The additional particle filter 13 is sealed by the sealing bead 14. The additional particle filter 13 is covered with an additional filter, an annular wall member or tray member 22 holding an extra single-layer coarse dust filter 3. To hold the filter 3, the cover 4' is secured on the circumference of the particle filter tray member 22. For this purpose an encircling projection 15 is provided on the tray member 22 over which the additional cover 4' snaps. The cover 4' also holds the filter tape of the particle filter 13 over the cover 22.

Knurled grips 11 are applied to both ends of the sleeve 2 to facilitate handling while screwing the sleeve 2 in the filter case 1 or unscrewing it.

There is the further possibility, not illustrated, of using a combination of only a particle filter 13 with a coarse dust filter 3, omitting the gas filter 12. In this case, the sleeve 2 is preferably used as in FIG. 1, with the sealing bead 14 of the cover 22 of the particle filter 13 being pressed against the gasket 7 by the collar 8.

While a specific embodiment of the invention has been shown and described in detail to illustrate the application of the principles of the invention, it will be understood that the invention may be embodied otherwise without departing from such principles.

What is claimed is:

1. A respirator mask filter holder with reversible parts comprising a filter case having a wall with a tubular side which is interiorly threaded having an interior case bottom end and an opposite outer end, an exteriorly threaded sleeve having a first end with a radially inwardly extending fastener collar and an opposite second end, said sleeve having a threaded exterior being threadable with the threaded interior of said tubular side wall, so as to be adjustably positionable axially therein in a first position with said fastener collar being positionable toward said case bottom end and said second end of said sleeve being positionable toward said filter case outer end, said threaded sleeve being reversibly positionable in a second position in said tubular side wall so as to be adjustably positionable axially therein in a second position with said fastener collar being positionable toward said filter case outer end and said second end of said sleeve being positionable toward said case bottom, at least one filter cover having at least one replaceable filter therein and having a radially outwardly extending projecting lip engageable with said fastener collar for holding said at least one filter cover in said filter case and toward said case bottom.

2. A respirator mask filter holder according to claim 1, wherein said filter case bottom has an interior annular ledge with an annular gasket thereon, at least one gas filter in said filter case, a first of said at least one filter cover having a first end with a sealing bead extending radially outwardly and securely sealingly holding said at least one gas filter against said annular gasket, said first of said at least one filter cover having a second end with an exterior encircling projection, a second of at least one filter cover having an interior annular recess snap fittable over said exterior encircling projection of said first of said at least one filter cover.

* * * * *